United States Patent [19]

Singer

[11] 4,095,757

[45] Jun. 20, 1978

[54] YARN TENSION DEVICE

[76] Inventor: Hans S. Singer, 191 Inglewood, Greenville, S.C. 29609

[21] Appl. No.: 664,689

[22] Filed: Mar. 8, 1976

[51] Int. Cl.[2] ..... B65H 59/20

[52] U.S. Cl. ..... 242/151; 242/152.1

[58] Field of Search ..... 242/152.1, 147 R, 149, 242/151, 152, 153, 154

[56] References Cited

U.S. PATENT DOCUMENTS

| | | | |
|---|---|---|---|
| 1,014,256 | 1/1912 | Rieffel | 242/152.1 |
| 1,055,108 | 3/1913 | Wells | 242/151 X |
| 1,167,636 | 1/1916 | Eastwood | 242/152.1 |
| 1,211,862 | 1/1917 | Lister | 242/152.1 |
| 1,372,557 | 3/1921 | Sawtell | 242/152.1 |
| 1,437,997 | 12/1922 | Sawtell | 242/152.1 |
| 1,490,512 | 4/1924 | Hill et al. | 242/152.1 |
| 3,874,613 | 4/1975 | Zollinger | 242/152.1 |

FOREIGN PATENT DOCUMENTS

| | | | |
|---|---|---|---|
| 382,322 | 10/1923 | Germany | 242/151 |
| 717,844 | 10/1931 | Italy | 242/152.1 |
| 126,805 | 5/1919 | United Kingdom | 242/151 |
| 808,133 | 1/1959 | United Kingdom | 242/149 |

*Primary Examiner*—Stanley N. Gilreath

[57] ABSTRACT

A yarn tension device is illustrated wherein a concave arcuate surface defines an indentation extending across and below a yarn channel forming an arcuate interruption in the yarn channel for receiving an arcuate rotatable element for rotation by the yarn as it moves through the yarn channel. It is further contemplated that a housing provide an upright receptacle for receiving a number of rotatable elements for rotation by the yarn utilizing the force required to rotate the rotatable elements for tensioning the yarn. A number of receptacles receiving rotatable elements may be provided in spaced aligned relation to vary the amount and mode of tension application. A side opening yarn entrance passageway is contemplated for self-threading the yarn beneath a rotatable element.

9 Claims, 7 Drawing Figures

YARN TENSION DEVICE

BACKGROUND OF THE INVENTION

Yarn tensioning devices have been provided assuming a wide variety of configurations. Such devices are extremely important because of their many areas of usefulness in the textile industry. Because of complicity of the problems engendered in the tensioning of a moving strand this has become a highly developed art. One type of yarn tension device in common use in textile industry utilizes tensioning disks, a number of pairs of which may be provided in spaced aligned relation, such as exemplified in U.S. Pat. No. 3,132,824. Other tension devices utilize arcuate rotatable elements such as balls. What constitutes substantially a point contact between the rotatable element and the yarn is illustrated in U.S. Pat. Nos. 1,372,557, 1,432,399 and 3,753,535. Because of the point contact, full advantage is not obtained from rotation imparted by yarn movement because of limited contact between the yarn and the ball. The yarn in such instances has the tendency, always following the path of least resistance, to come out from under the ball with consequent irregularities in or loss of tension. The tendency of such devices to pinch the yarn is thought to also produce undesirable results. Where the wrap of the yarn about the rotatable device is excessive, such as illustrated in U.S. Pat. Nos. 1,040,185 and 1,490,512, there is a tendency for the ball to bounce up and down producing irregular tension, and the force of inertia resulting from repeated impacts tending to damage the yarn.

Accordingly, it is an important object of this invention to provide a yarn tension device utilizing a rotatable element in engagement with the yarn which will result in more nearly uniform tension without excessive tendency to pinch the yarn.

Another important object of the invention is to produce a yarn tensioning device which may rely to a greater degree upon the kinematic action of rotating elements wherein the force required to rotate the elements acts to tension the yarn by retarding its forward movement.

Another important object of the invention is to provide a tension device wherein the amount, as well as the mode of application of the tension are subject to a variety of adjustments.

Still another important object of the invention is to provide a yarn tension device having a self-threading feature wherein the yarn may be presented for readily passing under the rotatable elements. Yarn guides may also be provided for maintaining the yarn in such position within a yarn channel.

BRIEF DESCRIPTION OF THE INVENTION

It has been found that a versatile tension device providing a high degree of uniformity of tension may be provided utilizing a concave arcuate surface defining an indentation extending across and below a yarn channel forming an interruption therein of such extent that the yarn will wrap about a rotatable element carried within the indentation sufficiently to rotate the rotatable element.

It is also contemplated that a housing may be provided having one or more aligned upright receptacles opening into the yarn channel with means for positioning the rotatable elements for driving engagement by the yarn at spaced positions along the yarn channel.

A side opening yarn entrance passageway may be provided in the housing opening into the yarn channel beneath the rotatable elements for conveniently raising the rotatable elements for entry of the yarn into the yarn channel beneath the rotatable elements.

A yarn guide may be carried by the housing for maintaining the yarn in position within the yarn channel and such yarn guides have yarn guiding surfaces below the yarn channel.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
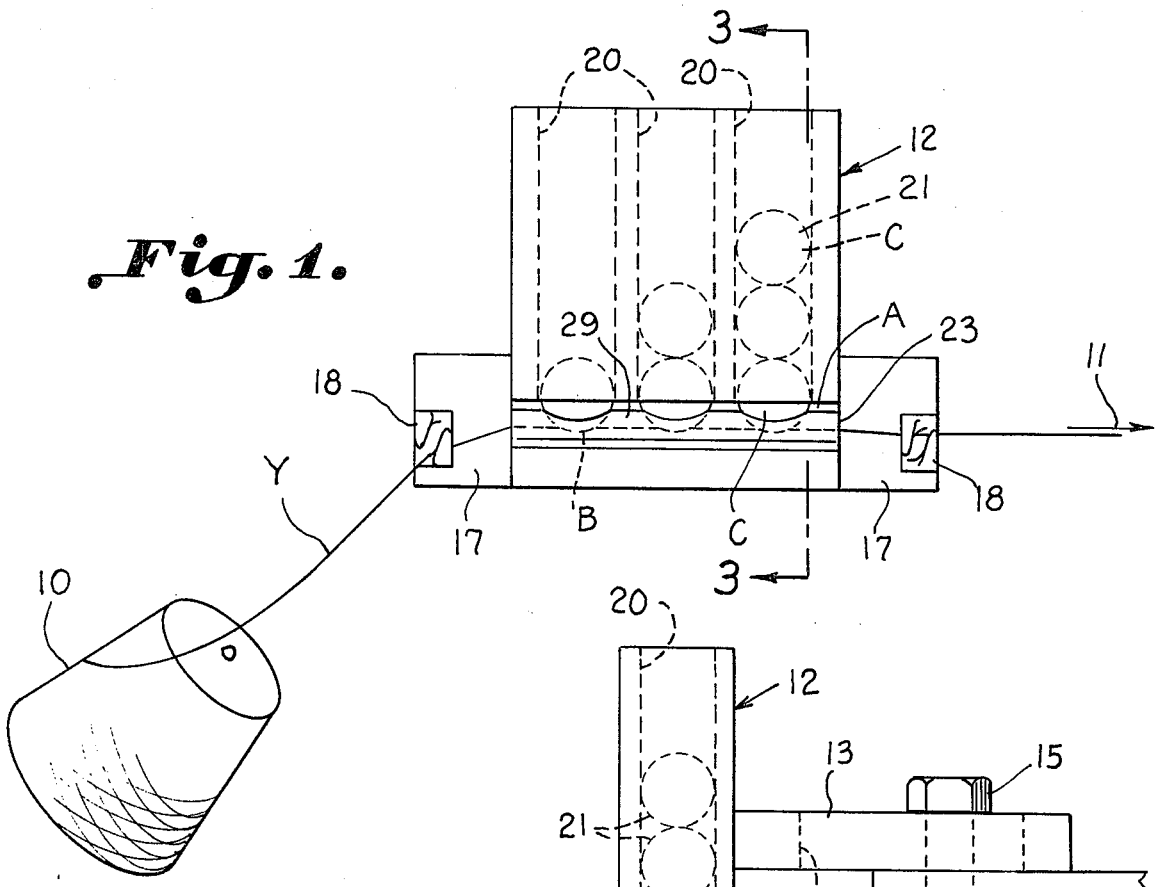
FIG. 1 is a front elevation illustrating a yarn tensioning device constructed in accordance with the present invention.

The drawing illustrates a yarn tension device having a member with walls A defining an elongated yarn channel. A concave arcuate surface defines an indentation in the member extending across and below the channel forming an arcuate interruption B in the yarn channel. An arcuate rotatable element C is carried in the arcuate indentation. The arcuate rotatable element has a surface corresponding to the concave arcuate surface. The arcuate interruption B is of such extent as to cause the yarn moving through the yarn channel to wrap around a portion of the arcuate rotatable element C within the arcuate interruption sufficiently to rotate said rotatable element.

Referring more particularly to FIG. 1, yarn Y is illustrated as moving from a source such as a cone 10 through the tension device toward a destination in the direction of the arrow 11. The yarn tension device includes a housing broadly designated at 12 having a bracket 13 extending rearwardly therefrom and containing an elongated slot 14 for accommodating a bolt 15 for adjustably securing the yarn tension device adjacent textile machinery with which it is to be used, as upon a bracket or suitable support 16.

Figure 2:
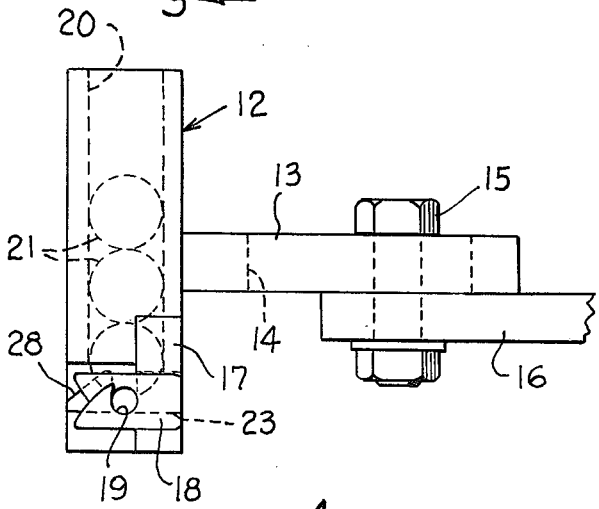
FIG. 2 is a side elevation further illustrating such yarn tensioning device.
Figure 6:
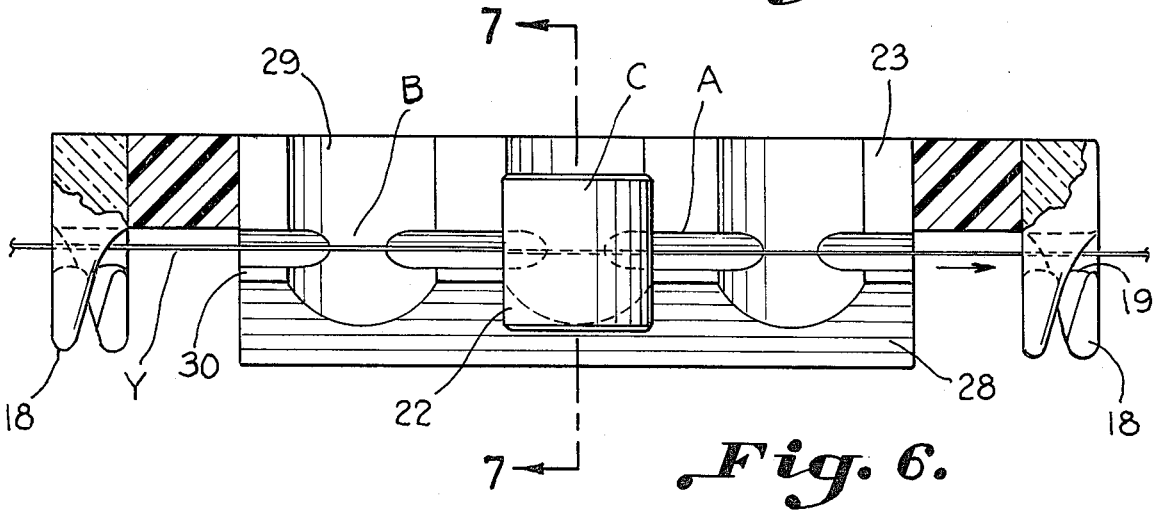
FIG. 6 is a top plan view illustrating a yarn channel and indentation of a device constructed in accordance with a modified form of the invention.
Figure 7:
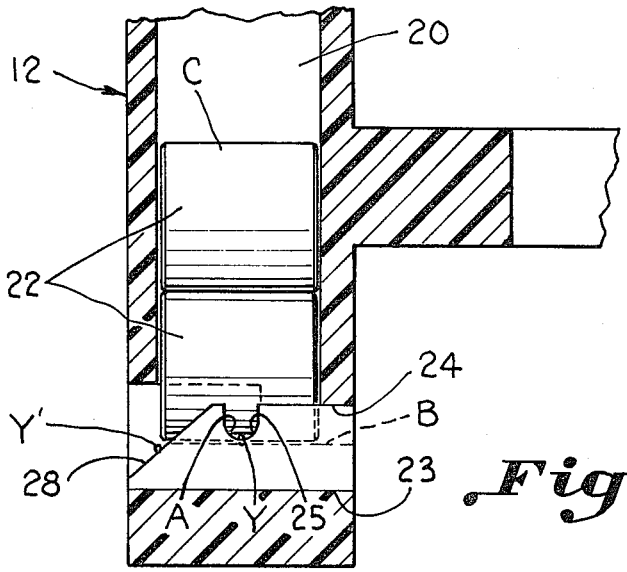
FIG. 7 is a transverse sectional elevation, similar to FIG. 3, taken on the line 7—7 of FIG. 6 further illustrating the modified form of the invention.

The housing 12 has a pair of opposed laterally extending projections 17, each of which carries a yarn guide 18 defining a side opening eyelet 19 (FIG. 2). Each eyelet provides a surface for guiding the yarn and maintaining same below the yarn channel A so as to retain the yarn therein during its passage through the yarn tensioning device. The housing provides a plurality of upright spaced longitudinally aligned receptacles 20 which may be of suitable shape to accommodate rotatable elements C stacked therein in superposed relation. The rotatable elements C have arcuate surfaces and are illustrated in FIGS. 1 through 5 as being in the form of spheres or balls 21. FIGS. 6 and 7 illustrate rotatable elements C in the form of cylindrical rollers 22.

A member is provided in the form of an insert 23 which is carried within a corresponding recess 24 (FIG. 3) within the housing 12. The insert 23 may be carried in the recess as by a pressed fit so as to be removable and replaceable, or such may be molded or glued or otherwise positioned therein. The member may be formed integrally with the housing which may be molded as of any suitable plastic. The insert 23 has walls A which define a longitudinal depression in the upper surface of the insert contituting an elongated yarn channel 25.

Figure 4:
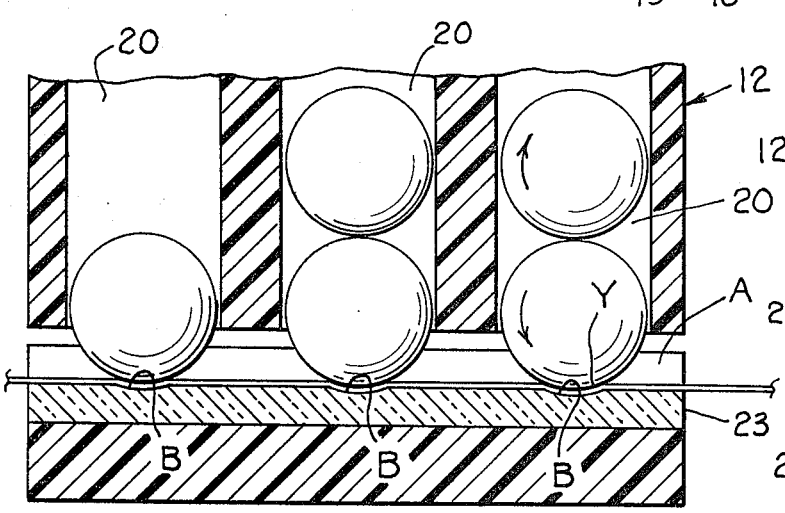
FIG. 4 is a longitudinal sectional elevation taken on the line 4—4 in FIG. 3.
Figure 3:
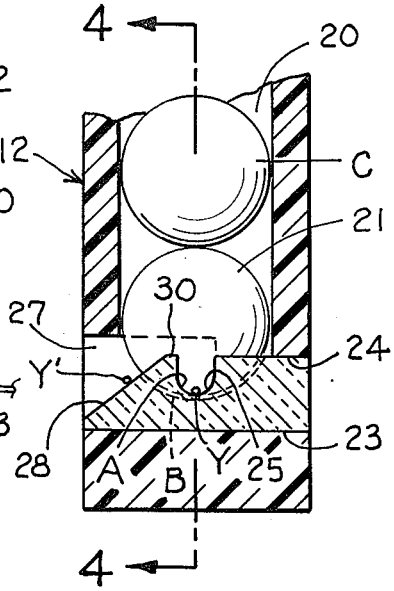
FIG. 3 is an enlarged transverse sectional elevation taken on the line 3—3 in FIG. 1.
Figure 5:
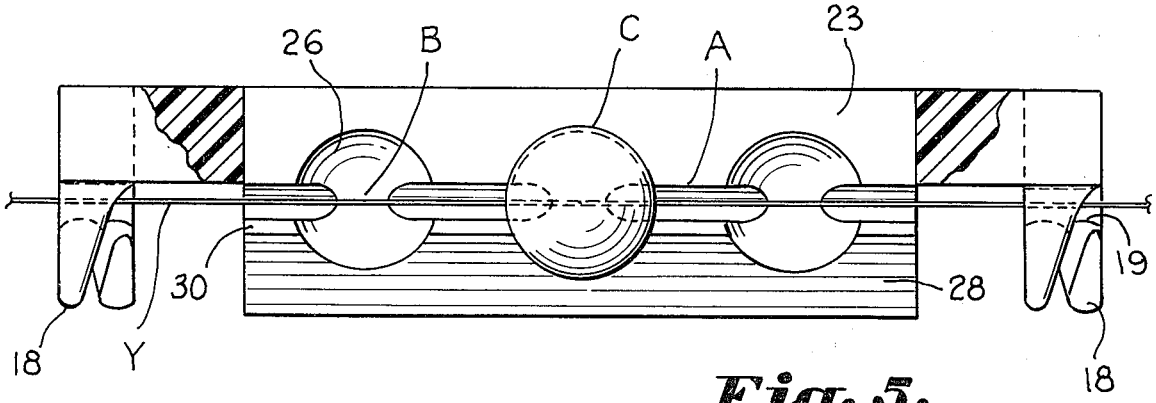
FIG. 5 is a top plan view illustrating a yarn channel and indentation of a device constructed in accordance with the present invention.

A concave arcuate surface illustrated in FIGS. 1 through 5 in the form of an arcuate indentation 26 in the insert extending across and below the channel forms an arcuate interruption B in the yarn channel. The indentation is such as to receive an arcuate rotatable element C illustrated in FIGS. 1 through 5 in the form of spherical rotatable elements. The interruption B, as illustrated in FIG. 4, is so configured as to produce a sufficient wrap of yarn Y about the rotatable elements as to cause rotation thereof during the passage of the yarn towards its destination. Since a number of stacked rotatable elements C may be contemplated, it is desirable that each succeeding rotatable element turn the other so that the elements of each stack are rotated as illustrated by the arrows in FIG. 4. It will be observed that anywhere from a single rotatable element positioned in a single receptacle to a number of rotatable elements filling or partially filling each receptacle may be utilized. More or less elements may be carried in selected receptacles, as for example, the first receptacle traversed by the yarn may be filled if relatively high initial tension is desired with progressively less rotatable elements in succeeding receptacles. This sequence may be reversed or rotatable elements omitted from selected receptacles. The ability to vary the application of tension as high or low initial or other tension is important depending upon the characteristics of the yarn as, smooth, nub, streach, degree of twist, etc. For example, it may be desirable to have low initial tension to remove kinks from yarn having high twist characteristics. Of course, the more rotatable elements used, the greater will be the tension exerted at that position along the yarn guide. It is important that the interrupting surface B produces a configuration as to neither result in excessive pinching of the yarn as because of minimal contact with the rotatable element, nor excessive variation in tension as because of bouncing of the rotatable element from excessive contact as the yarn passes through the yarn guide under the influence of the rotatable element. The arcuate interruption illustrated bridges the interrupted ends of the yarn channel.

The configuration of the indentation and the yarn guide may be further exemplified with reference to more specific dimensions wherein the yarn channel is approximately $\frac{1}{8}$ inch in width, the diameter of the ball $\frac{1}{2}$ inch and the diameter of the circle generating the arc of the indentation 17/32 inch. It is thus important to note that the arcuate surface of the rotatable element corresponds to the arcuate surface of the indentation. It is significant that the surface of the rotatable element is illustrated to be slightly the lesser in diameter. The construction utilizing the foregoing dimensions may generate a longitudinal run opposite the interrupted ends of the yarn channel as illustrated in FIG. 4, of about 3/16 inch. Preferably, the entire insert 23 wherein the channel and indentations are made, is constructed of ceramic or other hard smooth material which is subject to minimum wear and dirt accumulation as often utilized in yarn guides and tensions. The rotatable elements are preferably steel and if rollers are utilized less yarn wrap is required to produce rotation with little or no chance of the yarn coming out from under the roller. Since there is a line contact between the rollers, rather than point contact as between balls, there may be more resistance to turning stacked balls.

A side yarn entrance passageway 27 (FIG. 3) is illustrated as being formed within the housing and including upwardly and inwardly tapering camming surface 28 carried at the front of the insert 23 so as to guide the yarn into a position Y′ beneath the rotatable elements preparatory to passing over the lip 30 into the yarn channel to its ultimate location within the yarn channel and beneath the rotatable elements as illustrated at Y.

FIGS. 6 and 7 illustrate a modified form of the invention wherein like reference characters are used to designate like parts. Rotatable elements C are illustrated in the form of aligned cylindrical rollers 22. Elongated transverse indentations 29 are carried in the insert to accommodate the rollers 22. It will be observed that the cylindrical rotatable elements 22 extend outwardly over the yarn guide surface 28 so that the yarn may be conveniently carried beneath the rollers and into the yarn channel.

It is thus seen that an extraordinarly versatile yarn tensioning device has been provided wherein more nearly uniform yarn tension has been afforrded. The yarn passageway illustrated in the form of a channel positions the yarn for tensioning as a result of the rolling friction resulting from turning the rotatable element, as well as the sliding friction between the yarn and the element. If desired, the receptacles need not be vertical as illustrated and in fact, infinite tension adjustment may be made possible, supplementing the adjustment made by the addition and subtraction of balls or rollers, by canting the housing so as to partially support the elements in the upright receptacles.

While a preferred embodiment of the invention has been described using specific terms, such description is for illustrative purposes only, and it is to be understood that changes and variations may be made without departing from the spirit or scope of the following claims.

What is claimed is:

1. A yarn tension device comprising:

a member having walls defining an elongated yarn channel;

a plurality of longitudinally aligned concave arcuate surfaces defining indentations in said member each indentation extending across and below said channel forming a continuous arcuate interruption in said yarn channel;

an arcuate rotatable element carried in each said arcuate indentation by gravity;

each said arcuate rotatable element having a surface corresponding generally but being slightly smaller than said concave arcuate surface of its corresponding indentation; and said arcuate interruptions being of such extent as to cause the yarn moving through said yarn channel to wrap around a portion of each of said arcuate rotatable elements within said arcuate interruptions sufficiently to rotate said rotatable elements.

2. The structure set forth in claim 1 including, a housing, and said member comprising an insert carried within a recess in said housing.

3. The structure set forth in claim 1 including a plurality of spaced aligned upright receptacles in said housing.

4. The structure set forth in claim 1 wherein said arcuate rotatable elements are in the form of balls.

5. The structure set forth in claim 1 wherein said arcuate rotatable elements are in the form of cylindrical rollers.

6. A yarn tension device utilizing arcuate rotatable elements comprising:

a housing;

an elongated yarn passageway within said housing;

a plurality of spaced longitudinally aligned upright receptacles in said housing opening into said yarn passageway for carrying a plurality of said arcuate rotatable elements in stacked relation therein; and means for positioning the lowermost arcuate rotatable element in rotating engagement with said yarn at spaced positions along said yarn passageway.

7. The method of tensioning a moving textile yarn comprising: Successively rotating a plurality of stacked superimposed aligned cylindrical rollers responsive to driving engagement by the yarn beneath the lowermost aligned roller applying a retarding force to movement of the yarn, and simultaneously so rotating at least one other cylindrical roller at a spaced location along the yarn.

8. A yarn tension device comprising:

a member having walls defining an elongated yarn channel;

a concave arcuate surface defining an indentation in said member extending across and below said channel forming an arcuate interruption in said yarn channel;

a first cylindrical roller carried in said arcuate indentation;

said first cylindrical roller having a surface corresponding generally but being slightly smaller than said concave arcuate surface;

said arcuate interruption being of such extent as to cause the yarn moving through said yarn channel to wrap around a portion of said first cylindrical roller within said arcuate interruption sufficiently to rotate said first cylindrical roller; and a vertical housing supporting at least one additional cylindrical roller stacked above and engaging said first cylindrical roller for rotation thereby.

9. The structure set forth in claim 8 including a plurality of longitudinally aligned concave arcuate surfaces for carrying cylindrical rollers spaced longitudinally along a path of movement of the yarn.

* * * * *